United States Patent [19]

Lampert

[11] 3,984,264

[45] Oct. 5, 1976

[54] SILOXANE COATINGS FOR SOLID PROPELLANT INGREDIENTS

[75] Inventor: Bernard B. Lampert, Carmichael, Calif.

[73] Assignee: The United States of America as represented by the Secretary of the Army, Washington, D.C.

[22] Filed: Apr. 1, 1969

[21] Appl. No.: 812,469

[52] U.S. Cl. ..... 149/7; 149/11; 149/92; 264/3 R

[51] Int. Cl.[2] ..... C06B 45/34

[58] Field of Search ..... 117/100, 119; 149/7, 149/11; 264/3

[56] References Cited

UNITED STATES PATENTS

| | | | |
|---|---|---|---|
| 3,190,775 | 6/1965 | Ender | 149/7 X |
| 3,190,776 | 6/1965 | Ender | 149/7 X |
| 3,373,062 | 3/1968 | Morris | 149/6 |

*Primary Examiner*—Leland A. Sebastian
*Attorney, Agent, or Firm*—Nathan Edelberg; Robert P. Gibson

[57] ABSTRACT

This patent describes high energy propellant ingredients in particulate form containing thereon a cross-linked siloxane polymer envelope or coating from an organic hydrolyzable silane having a functionality greater than 2. This patent also describes a method of providing a cross-linked siloxane polymer coating on finely divided high energy propellant ingredients by suspending the finely divided ingredients in an inert solvent, introducing therein a hydrolyzable organic silane having a functionality greater than 2 and subsequently isolating the polymer coated product in a dry free-flowing particulate form after stripping of the solvent.

16 Claims, No Drawings

SILOXANE COATINGS FOR SOLID PROPELLANT INGREDIENTS

BACKGROUND OF THE INVENTION

Silane coupling agents based on the organotrifunctional silanes are now well-known. The silicon portion of these compounds have a unique affinity for glass, aluminum, steel and similar substrates. These compounds are commonly employed to establish chemical bond between organic polymers and inorganic materials. For example, they are ordinarily added to organic polymers intended to bond to inorganic fillers or surfaces. In contrast thereto the present invention instead of employing these coupling agents in the conventional manner, takes advantage of their trifunctionality and ability to form crosslinked siloxane coatings. More specifically, it has now been found that certain organic hydrolyzable silanes having a functionality greater than 2 can be applied to particulate high energy solid rocket propellant ingredients to form thereon coatings of an organic crosslinked siloxane polymer which provides a free-flowing product. In addition, the use of the coated particles in propellants has quite surprisingly been found to increase the burning rate of the propellant.

SUMMARY OF THE INVENTION

Briefly, the present invention comprises high energy propellant ingredients in particulate form containing thereon a crosslinked siloxane polymer envelope or coating from an organic hydrolyzable silane having a functionality greater than 2.

This patent also describes a method of providing a crosslinked siloxane polymer coating on finely divided high energy propellant ingredients by suspending the finely divided ingredients in an inert solvent, introducing therein a hydrolyzable organic silane having a functionality greater than 2 and subsequently isolating the polymer coated product in a dry free-flowing particulate form after stripping of the solvent.

It is an object of the present invention to provide a novel class of coated high energy solid rocket propellant ingredients.

Another object of the present invention is to provide a novel method for the production of a siloxane coating on solid rocket propellant ingredients.

These and other objects and advantages of this invention will be apparent from the more detailed description which follows.

DESCRIPTION OF PREFERRED EMBODIMENTS

This invention provides a coating for solid propellant ingredients. The exact function of the coating varies with the ingredient to be coated. For example, ammonium perchlorate coated according to this invention, when used as the propellant oxidizer, provides a propellant with increased burning rate and slope, and the particle size of ultrafine ammonium perchlorate is preserved without recrystallization or agglomeration. The coating of HMX or RDX results in enhanced mechanical properties of the propellants containing these ingredients.

The polymeric crosslinked siloxane coating may be varied as to type of functionality to meet the particular requirements and limitations of the propellant systems. Many monomeric materials may be utilized to produce the siloxane coating. An example of a siloxane coupling agent which is capable of providing a three-dimensional siloxane coating in accordance with the present invention is N-beta-(aminoethyl)-gamma-aminopropyltrimethoxysilane. When this material is coated on a solid propellant ingredient, crosslinking is accomplished by hydrolysis of the methoxy groups with water, giving it is believed, a trihydroxysilane which is unstable and polymerizes with liberation of water, forming a three-dimensional siloxane polymer coating. The water for hydrolysis normally comes from the atmosphere or from the absorbed moisture on the ingredient itself. Acetic acid is a catalyst for the hydrolysis of the methoxy groups.

In order to preserve the integrity of particle size it is preferred to carry out the coating operation in a low boiling solvent in which the solid propellant oxidizer is insoluble and preferably one with which the silane is miscible. In the case of N-beta-(aminoethyl)-gamma-aminopropyltrimethoxysilane, it is desirable that the solvent form an azeotrope with methanol, the product of the hydrolysis of this silane. n-Heptane or benzene are suitable solvents for this purpose. Freon 113 is a suitable solvent also, but since this silane is immiscible with Freon 113 it is convenient to dilute the silane with methylene chloride with which it is miscible.

Acetone is less desirable as a coating solvent for ammonium perchlorate, because of the partial solubility of the oxidizer in this solvent. More suitable solvents were n-heptane or ethylene dichloride. Moreover, since ammonium perchlorate is the salt of a weak base, ammonia is liberated in the presence of N-beta-(aminoethyl)-gamma-aminopropyltrimethoxysilane. It is possible to prevent the liberation of free ammonia by buffering the ammonium perchlorate-solvent slurry with glacial acetic acid before introduction of the silane.

The coating process is preferably carried out as follows: The ammonium perchlorate is suspended in a solvent and stirred or agitated while a dilute solution of the silane is introduced dropwise. After complete reaction the flask is transferred to an evaporator and the solvent is stripped at approximately 100°F and reduced pressure until dry. The product is a uniformly coated free-flowing powder.

An alternate, in situ, coating process is also feasible wherein the solid to be coated is suspended in the binder or binder ingredient, such as the plasticizer. This is convenient, because the process may be carried out in the propellant mixer apparatus. The silane is introduced, the mixer blades activated, and when the reaction is complete vacuum is applied to remove volatiles. Propellant processing may then be continued in the mixer. Cyclotetramethylenetetranitramine (HMX) was successfully coated in trimethylolethane trinitrate (TMETN) or bis-(dinitropropyl) acetal/bis-(dinitropropyl) formal (BDNPA/BDNPF) plasticizer.

A propellant containing ammonium perchlorate treated with 6% of N-beta-(aminoethyl)-gamma-aminopropyltrimethoxysilane exhibited a 2–3 fold increase in liquid strand burning rate at 1000 psia over a control propellant.

The invention is particularly applicable to the amine-containing silanes, such as:

$$H_2N(CH_2)_2NHCH_2CH(CH_3)CH_2SiCH_3(OCH_3)_2$$

and $$H_3CO_2C(CH_2)_2NH(CH_2)_2NH(CH_2)_3Si(OCH_3)_3$$

Another suitable silane is:

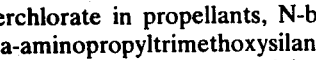

This silane is non-basic, and unlike those referred to above, does not substantially increase the burning rate of the propellant. However, non-basic silane yields a polymer coating which is effective in preventing agglomeration.

In addition to its effect on combustion of ammonium perchlorate in propellants, N-beta-(aminoethyl)-gamma-aminopropyltrimethoxysilane also has the effect of maintaining submicron particle size of ammonium perchlorate. For example, ultrafine ammonium perchlorate (less than one micron in diameter) is obtained by grinding the oxidizer in Freon 113 solvent. If ground in the absence of a coating agent the ammonium perchlorate particles tend to recrystallize on drying and agglomerate to form larger particles. Since burning rate is a function of particle size, it is desirable to preclude post grinding agglomeration. Treatment of the ultrafine ammonium perchlorate with up to 1% N-beta-(aminoethyl)-gamma-aminopropyltrimethoxysilane provides the necessary coating to maintain the fine particle size as obtained in the mill.

Other solid propellant ingredients, such as HMX, RDX, and ammonium nitrate may also be coated with silanes according to this invention. The silane is used in an amount sufficient to coat the oxidizer or other propellant ingredient, normally up to about 10% by weight of the ingredient, and more preferably, about 2 or 3% by weight.

The following examples are presented solely to illustrate the invention:

EXAMPLE I

Cyclotetramethylenetetranitramine (HMX) was coated with up to 30% siloxane in the absence of solvent by merely wetting the solid with N-beta-(aminoethyl)-gamma-aminopropyltrimethoxysilane and stirring the mixture in air at ambient temperature until almost dry. Complete drying was accomplished in a 130°F oven. For a lesser concentration (e.g., 5%), it was more convenient to slurry the HMX in acetone (1-g HMX per 0.23-g acetone) or n-heptane (1-g HMX per 0.32-g n-heptane), introduce the silane and stire to obtain a uniform coating. The acetone was stripped, and drying was accomplished at 130°F. Microscopic examination showed particles with a uniform coating which was insoluble in DMF. Impact sensitivity of HMX coated with 1% siloxane (I) was 17.5 cm/2-Kg wt (50% point), and spark sensitivity was 2.4 Joules (50% point); uncoated HMX had an impact sensitivity of 32 cm/2-Kg wt and spark sensitivity of 1.7 Joules.

HMX can also be coated in the presence of TMETN (trimethylolethane trinitrate) or BDNPA/BDNPF (1/1) plasticizers. HMX wet with 26.5% TMETN was treated with N-beta-(aminoethyl)-gamma-aminopropyltrimethoxysilane (5% based on HMX) for about 2–3 hours. Microscopic examination showed that the particles had a firm coating. Treatment in 22 wt% BDNPA/BDNPF gave similar results.

EXAMPLE II

A 200-g batch of ultrafine ammonium perchlorate was coated by slurrying the oxidizer in 240-ml of n-eptane and adding portionwise 12-g of N-beta-(aminoethyl)-gamma-aminopropyltrimethoxysilane dissolved in 35-ml of n-heptane. The product, a dry, free-flowing powder was obtained by evaporating the slurry under reduced pressure with an evaporator at approximately 100°F. A previous batch employed 150-g of the ammonium perchlorate in 150-ml of n-heptane and 9-g of silane in 25-ml of n-heptane. Impact sensitivity of the product was 19 cm/2-Kg wt (50% point).

EXAMPLE III

Eight pounds of ultrafine ammonium perchlorate were coated by grinding microatomized ammonium perchlorate in Freon 113 slurry for 18 hours before introducing 1 wt% (based on AP) N-beta-(aminoethyl)-gamma-aminopropyltrimethoxysilane dissolved in methylene chloride. The product dried without agglomeration by merely allowing the slurry to evaporate at atmospheric pressure in an oven.

EXAMPLE IV

Propellant containing ammonium perchlorate treated with N-beta-(aminoethyl)-gamma-aminopropyltrimethoxysilane exhibited a 2 to 3 fold increase in liquid strand burning rate at 1000 psia over a control propellant. Microatomized ammonium perchlorate with 6% siloxane coating was prepared as in Example II. The propellant formulation and burning rate results were as follows:

| Batch No. 7390-18 Ingredients, wt% | B (Control) | | C | |
|---|---|---|---|---|
| Binder* | 25 | | 25 | |
| Aluminum (H-60) | 20 | | 20 | |
| AP - unground | 27.5 | | 27.5 | |
| AP-MA | 27.5 | | 27.5** | |
| Liquid Strand Burning Rate in./sec at 1000 psia | 2-in. | 4-in. | 2-in. | 4-in. |
| | .225 | .224 | .639 | .612 |
| | .258 | .272 | .587 | .572 |
| | .259 | .296 | .617 | .620 |
| | | | .654 | .650 |

*Master batch: RCF-1/trimethylolpropane/3-nitrazapentane diisocyanate, (80/20/110 equiv.), and bis(dinitropropyl) formal/bis(dinitropropyl) acetal (1/1), (50 wt%).

**Microatomized ammonium perchlorate previously treated with approximately 6% N-beta-(aminoethyl)-gamma-aminopropyltrimethoxysilane.

EXAMPLE V

Ammonium nitrate was treated with 6 wt% N-beta-(aminoethyl)-gamma-aminopropyltrimethoxysilane as per Example II. Liberation of ammonia was detected, as with AP, and a discreet coating was observed microscopically upon completion.

Having fully defined the invention it is intended that it be limited only by the lawful scope of the appended claims.

I claim:

1. A high energy propellant ingredient selected from the group consisting of ammonium perchlorate, cyclotetramethylenetetranitramine, ammonium nitrate, cyclotetramethylenetrinitramine and propellants containing same, in particle form containing thereon a crosslinked siloxane polymer coating from a hydrolyzable organic silane having a functionality greater than 2.

2. Ammonium perchlorate in particle form containing thereon a crosslinked N-substituted amino alkyltrialkoxysiloxane coating from a hydrolyzable N-substituted amino alkyltrialkoxysilane having a functionality greater than 2.

3. A high energy propellant ingredient selected from the group consisting of ammonium perchlorate, cyclotetramethylenetetranitramine, ammonium nitrate, cyclotetramethylenetrinitramine and propellants containing same, in particle form containing thereon a crosslinked siloxane polymer coating of hydrolyzed N-beta-(aminoethyl)-gamma-aminopropyltrimethoxysilane.

4. The method of providing a crosslinked siloxane polymer coating on a finely divided high energy propellant ingredient which comprises suspending the finely divided ingredient in an inert solvent, introducing therein a hydrolyzable organic silane having a functionality greater than 2, and subsequently isolating the finely divided product in a dry free-flowing form after stripping of the solvent.

5. The method of providing a crosslinked siloxane polymer coating on a finely divided high energy propellant oxidizer which comprises suspending the finely divided oxidizer in an inert solvent, introducing therein a hydrolyzable organic silane having a functionality greater than 2, and subsequently isolating the finely divided product in a dry free-flowing form after stripping of the solvent.

6. A method of increasing burning rate and slope of a solid propellant which comprises coating the propellant oxidizer selected from the group consisting of perchlorates and nitrates with up to 10 wt% of a basic, polyfunctional N-substituted amino alkyltrialkoxysilane hydrolyzing the silane to provide a N-substituted amino alkyltrialkoxysiloxane polymer, and incorporating said oxidizer in a solid propellant.

7. A method of increasing burning rate and slope of an ammonium perchlorate which comprises coating the ammonium perchlorate with up to 10 wt% of a basic, polyfunctional N-substituted amino alkyltrialkoxysilane hydrolyzing the silane to provide a crosslinked siloxane polymer and incorporating said ammonium perchlorate in a solid propellant.

8. A method of preserving the ultrafine particle size of a high energy propellant ingredient which comprises coating the ingredient with up to 3 wt% of a hydrolyzable polyfunctional N-substituted amino alkyltrialkoxysilane silane.

9. A method of preserving the ultrafine particle size of an ammonium perchlorate which comprises coating the ammonium perchlorate with up to 3 wt% of a polyfunctional N-substituted amino alkyltrialkoxysilane silane, and hydrolyzing the silane to provide a crosslinked siloxane polymer.

10. A novel high energy solid propellant comprising a binder and an oxidizer therefor in particle form containing thereon a crosslinked amino containing siloxane polymer coating obtained from a hydrolysis of an N-substituted amino alkyltrialkoxysilane having a functionality greater than 2.

11. A novel high energy solid propellant comprising a binder and an oxidizer therefor in said oxidizer being particle form and comprising ammonium perchlorate containing thereon a crosslinked amino containing siloxane polymer coating obtained from a hydrolyzable N-substituted amino alkyltrialkoxysilane having a functionality greater than 2.

12. The method of providing a crosslinked siloxane polymer coating on a finely divided propellant ingredient which comprises suspending said ingredient in an inert solvent, introducing a hydrolyzable N-substituted amino alkyltrialkoxysilane having a functionality greater than 2, portionwise to the agitated mixture, and isolating the product as a dry, free-flowing powder after complete reaction, by stripping the reaction mixture under reduced pressure.

13. The method of claim 12 wherein the solvent is methylene chloride.

14. The method of claim 12 wherein the solvent is n-heptane also benzene.

15. The method of preparing a propellant which comprises adding an oxidizer to a propellant binder in a propellant mixer, introducing a hydrolyzable N-substituted amino alkyltrialkoxysilane having a functionality greater than 2, activating the mixer blades, and when reaction is complete, applying a vacuum to remove volatiles prior to addition of the other solid ingredients to the propellant mix.

16. The process which comprises suspending a solid in a propellant plasticizer, in a propellant mixer introducing a hydrolyzable N-substituted amino alkyltrialkoxysilane having a functionality greater than 2, activating the mixer blades, and when reaction is complete, applying vacuum to remove volatiles prior to addition of the other ingredients.

* * * * *